United States Patent [19]

Vignini

[11] 4,006,548

[45] Feb. 8, 1977

[54] COUNTERBALANCE FOR HANDGUN

[76] Inventor: Walter R. Vignini, 1745 Congress Ave., Peekskill, N.Y. 10566

[22] Filed: Sept. 4, 1975

[21] Appl. No.: 610,098

[52] U.S. Cl. ..... 42/1 W; 42/1 ST

[51] Int. Cl.² ..... F41C 27/00; F41G 1/38

[58] Field of Search ..... 42/1 W, 1 S, 1 ST, 1 R, 42/71 P, 71 R, 72, 90, 94

[56] References Cited

UNITED STATES PATENTS

| | | | |
|---|---|---|---|
| 2,140,945 | 12/1938 | Swartz | 42/1 W |
| 2,705,846 | 4/1955 | Wale | 42/1 W |
| 2,921,396 | 1/1960 | Larson | 42/1 W |

*Primary Examiner*—Charles T. Jordan
*Attorney, Agent, or Firm*—Ostrolenk, Faber, Gerb & Soffen

[57] ABSTRACT

A counterbalance for a handgun in which a structure is secured to the rear of the gun and extends rearwardly thereof having sufficient weight, which may be adjustable to balance the weight of the gun forward of the pivot point (or wrist) of the user. The counterbalance structure is not intended as an arm rest and is not to engage the arm; it furnishes only a counterweight to the weight of the gun and is thus proper for competitive shooting.

9 Claims, 3 Drawing Figures

COUNTERBALANCE FOR HANDGUN

The present invention relates to handguns and more particularly to a counterbalance for a handgun which counterbalance may properly be used under competitive target shooting regulations and which will automatically perform the operation of so balancing the handgun that it will substantially equalize the weight of the parts around the pivot point and increase the total inertia of the parts.

In a handgun which is freely held with the arm at length at the time of shooting the pivot point may be regarded as the wrist of the user. During the operation of squeezing the trigger, the balancing of the handgun so that the weight is substantially equally distributed on either side of the pivot will ensure that the extended arm and wrist will be steadier during the firing of the gun and that a better target score will be achieved.

The type of counterbalance of a handgun should be distinguished from those extensions of handguns which are used, in effect, as arm rests in which the extension of the gun is designed to be braced against the forearm or a device carried by or secured to the forearm. In the case of the present invention the counterbalance extension which extends backwards from the gun grip is so designed as to provide only what is implied by the term counterbalance, -- that is a balancing of the gun; and not a rest or additional support for the gun. Since the counterbalance is thus not intended to or capable of providing a rest for the gun it is a proper and legitimate device for use in target or competitive shooting.

The primary object of the present invention is therefore the provision of a counterbalance on a handgun which will substantially equalize the weight of a gun forward and back of the pivot point of the wrist when the gun is used but, because it provides no arm rest or other support for the gun, is proper for target or competitive shooting.

Another object of the present invention is to provide an appreciable increase in the inertia of the system with a reasonable increase in the total weight of the system. The increased inertia decreases the gripping force required, decreases the vertical movement of the weapon due to recoil and decreases the lateral shift in aim during the squeezing of the trigger.

The foregoing and other objects of the invention will become apparent in the following description and drawings in which.

Figure 1:
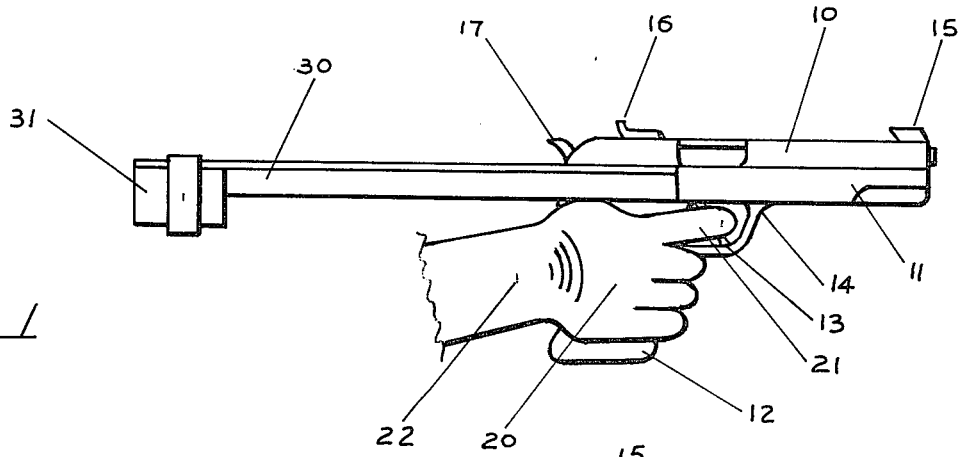
FIG. 1 is a side view of a handgun to which is secured the novel structure of the present invention.
Figure 2:
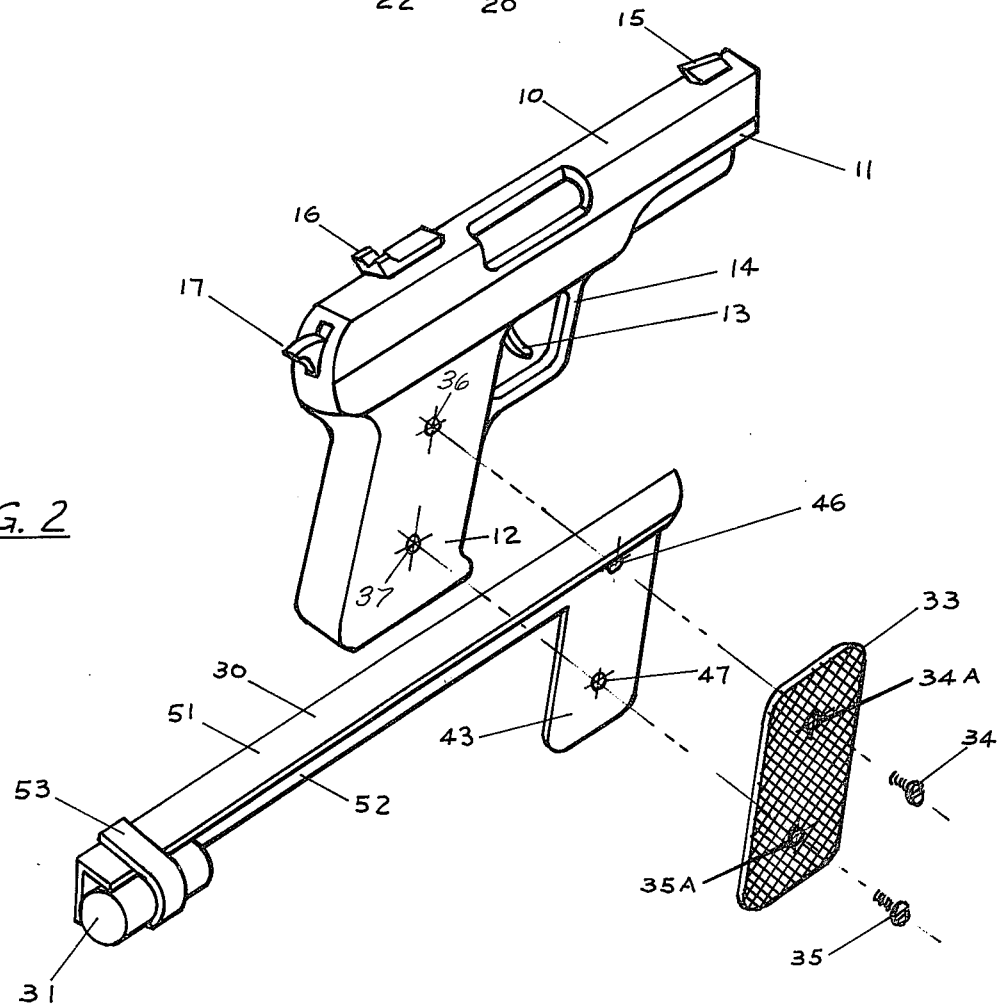
FIG. 2 is an expanded view of the gun of FIG. 1 showing a manner in which the counterbalancing structure may be secured thereto.

Referring first to FIGS. 1 and 2, the handgun 10 has the barrel section 11, the hand grip 12, the trigger 13 and the trigger guard 14, a bead sight 15 and a sight slot 16 as well as an appropriate cocking mechanism 17. When the hand 20 grips the hand grip 12 and the trigger finger 21 is extended to engage the trigger 13 it will be noted that the point of rotation is at the center of the wrist 22. In other words the hand 20 and the wrist 22 are required to hold the gun 10 in the desired usually horizontal position aimed at the target with all of the weight of the gun forward of the pivot point 22. As the trigger 13 is squeezed by the trigger finger 21 the mental concentration necessary to exert the required squeezing force and the mental and visual concentration required to keep the gun sighted are added to the physcial effort to hold the entire weight of the gun 10 which is forward of the pivot point at the wrist 22 on target.

The present invention provides a counterbalancing extension arm 30 and a counterbalancing weight 31 selectively positionable along the arm 30 so arranged that the extension 30 and the weight 31 provide a counterbalance for the weight of the gun 10. This thereby removes one of the major problems in target shooting and that is the holding of the gun on target against the weight of the handgun all of which prior to the present invention has been forward of the pivot point at the wrist 22.

One method of attaching the counterbalancing arm 30 is shown in FIG. 2 in which side plate 33 on one side of the grip 12 of the gun is removed by removing the screws 34, 35 which hold the same in place in the respective openings 36, 37 of the grip. The counterbalancing arm 30 is provided with an auxiliary plate 43 and corresponding openings 46 and 47 through which the screws 34 and 35 may pass. The counterbalancing structure is then reassembled with the screws 34, 35 passing first through openings 34A, 35A of plate 33, then through the openings 46, 47 of the plate 43 of the counterbalance arm 30 and then into the screw-receiving openings 36, 37 of the grip 12. In this case the counterbalancing arm 30 is shown as an arm of angular cross-section having an upper surface 51 and a vertical surface 52 to which the counterbalancing weight 31 may be secured in any suitable manner as by the rubberband 53.

Thus various different sizes or weight of counterbalance member 31 may be substituted on the counterbalancing arm 30 and the weight 31 may be fastened along the counterbalancing arm 30 to obtain the exactly desired location for the weight 31 for the particular user.

It will be obvious that other methods of securing the weight 31 in position on the counterbalancing arm 30 may readily be used.

By this means therefore a simplified device for counterbalancing a handgun is provided. The handgun is nevertheless available for competitive target shooting since the counterbalancing structure does not provide any type of arm rest structure and accuracy in target or competitive use has been substantially increased.

Figure 3:
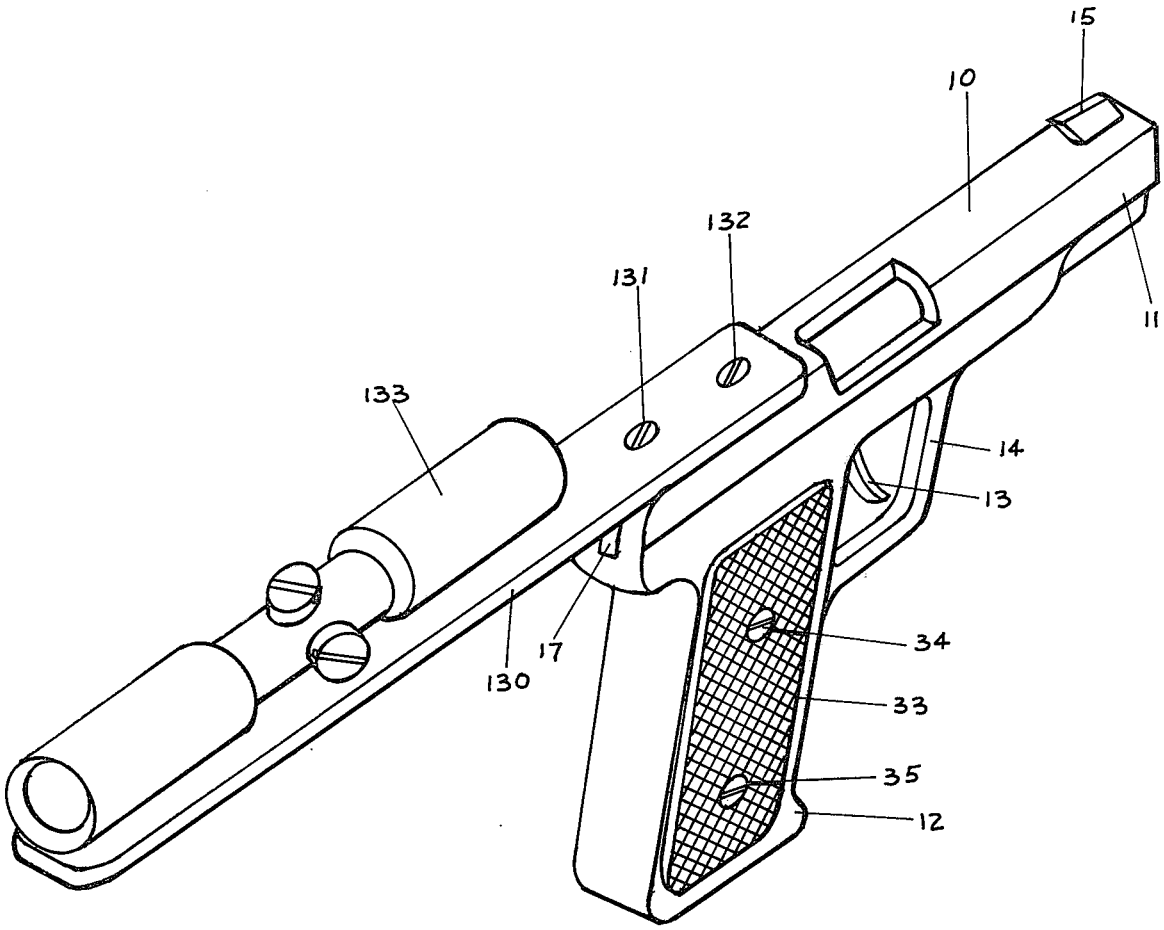
FIG. 3 is a veiw in perspective of a modified form of counterbalancing structure in which the counterbalance happens to be a telescopic sight.

In FIG. 3 there is shown a handgun similar to that shown in FIGS. 1 and 2. In this case the counterbalancing arm 130 comprises a substantially flat arm secured by appropriate screws 131, 132 to the rear portion of the top of the gun above the hand grip 12. The counterbalancing arm 130 carries a telescopic sight 133 which may be provided with appropriate cross hairs. The telescopic sight 133 is initially made of sufficient weight to provide appropriate counterbalancing. In addition, the telescopic sight may be shifted to provide variations of balance which may be required by variations in the hand of the individual user.

For a particular gun it will be obvious that a person with a small hand may well have the rest or pivot point much closer to the grip 12 than a person with a large hand and with long fingers. While therefore a similar counterbalance may be achieved even with weights that are not movable and counterbalancing arms which are not interchangeable, a movable weight or even counterbalancing arms of different lengths which may be provided or tailored to fit the individual users will provide a more effective counterbalance so that the weight on either side of the pivot point will be the same. Thus it may be desirable for instance for particular guns to provide a counterbalancing arm of different lengths for different size hands related either to glove size or related to the distance from the heel of the palm which engages the back of the grip 12 to the wrist pivot point.

In the present disclosure, relatively simple but effective means of adjustment are shown in connection with FIGS. 1 and 2 having the movable weight or in FIG. 3 with the telescopic sight being shiftable. The present invention has thus been described solely in connection with illustrative embodiments thereof. Since many variations and modifications will now be obvious to those skilled in the art, it is preferred that the scope of the invention be determined not by the specific disclosures herein contained but only by the appended claims.

The embodiments of the invention in which an exclusive privilege or property is claimed are defined as follows:

1. In a handgun having a barrel and a hand grip; said hand grip being adapted for engagement by the hand of the user with the gun held forwardly of the arm and wrist of the user;

a counterbalance arm securable to said gun and extending rearwardly of said hand grip in a direction opposite to the barrel;

said counterbalance arm being free of the hand, wrist and arm of the user;

said counterbalance arm providing a rotative moment rearwardly of the wrist of the user opposite to the rotative moment of the handgun.

2. The handgun and counterbalance of claim 1 in which the counterbalance arm is provided with an extension plate at one end thereof;

means for securing said extension plate to said hand grip.

3. The handgun and counterbalance of claim 2 in which said extension plate substantially matches one side surface of said hand grip and is secured to said side surface.

4. The handgun of claim 1 in which the counterbalance arm is provided with a counterpoise weight adjacent the end thereof opposite the point of securement of the counterbalance arm to said gun.

5. The handgun of claim 4 in which said counterpoise weight is adjustable along said counterbalance arm.

6. The handgun of claim 1 in which one end of said counterbalance arm is secured to the side of the hand grip at the rear of the gun.

7. The handgun of claim 1 in which one end of said counterbalance arm is secured to the top of the gun above the hand grip.

8. The handgun of claim 7 in which the counterbalance arm carries a sighting device.

9. The handgun of claim 8 in which said sighting device is also a counterpoise.

* * * * *